US006439015B1

(12) United States Patent
Sauerland et al.

(10) Patent No.: US 6,439,015 B1
(45) Date of Patent: Aug. 27, 2002

(54) CASEMENT CLOSURE DEVICE

(75) Inventors: Manfred Sauerland, Essen; Rainer Hoffmann, Langenfeld, both of (DE)

(73) Assignee: EMKA Beschlagteile GmbH & Co. KG (DE)

( * ) Notice: Subject to any disclaimer, the term of this patent is extended or adjusted under 35 U.S.C. 154(b) by 0 days.

(21) Appl. No.: 09/673,679

(22) PCT Filed: Apr. 3, 1999

(86) PCT No.: PCT/DE99/01060

§ 371 (c)(1),
(2), (4) Date: Dec. 14, 2000

(87) PCT Pub. No.: WO99/54577

PCT Pub. Date: Oct. 28, 1999

(30) Foreign Application Priority Data

Apr. 17, 1998 (DE) ..... 198 16 959

(51) Int. Cl.[7] ..... E05B 17/04

(52) U.S. Cl. ..... 70/368; 70/369; 70/379 R; 70/379 A

(58) Field of Search ..... 70/367–373, 375, 70/379 R, 379 A, 380

(56) References Cited

U.S. PATENT DOCUMENTS

| | | | | |
|---|---|---|---|---|
| 1,241,754 A | * | 10/1917 | Molden | |
| 1,832,108 A | * | 11/1931 | Falk | |
| 1,979,938 A | * | 11/1934 | Jacobi | |
| 3,877,268 A | | 4/1975 | Shull | 70/376 X |
| 4,142,390 A | * | 3/1979 | Schroeder | 70/371 |
| 5,152,161 A | * | 10/1992 | Lee | 70/DIG. 62 X |
| 5,295,377 A | * | 3/1994 | Moricz et al. | 70/379 R |
| 5,775,145 A | | 7/1998 | Kasper | 70/367 |
| 5,907,963 A | * | 6/1999 | Myers et al. | 70/371 |
| 5,931,035 A | * | 8/1999 | Bolton | 70/367 |

FOREIGN PATENT DOCUMENTS

| | | | | |
|---|---|---|---|---|
| DE | 4008649 A1 | * | 9/1991 | 70/367 |
| EP | 0 504 144 B1 | | 9/1992 | |
| EP | 0 677 632 A2 | | 10/1995 | |
| FR | 2624543 | * | 6/1989 | 70/380 |
| JP | 0045500 | * | 4/1977 | 70/380 |

* cited by examiner

*Primary Examiner*—Lloyd A. Gall
(74) *Attorney, Agent, or Firm*—R W Becker & Associates; R W Becker

(57) ABSTRACT

A casement closure device for a door is provided, and includes a housing adapted to be fixed to a door leaf or cabinet body. A key-operated lock cylinder is removably disposed in a channel of the housing. A locking tongue is held against the housing and is rotatable between an unlocking and a locking position. The lock cylinder is uncoupled from the locking tongue and is locked in the housing when a key is withdrawn from the lock cylinder. When a key is inserted and moved to the unlocking position, the lock cylinder is removable. The locking tongue is provided with an actuation opening adapted to positively engage an actuating unit insertable in the housing channel when the lock cylinder is removed from the housing.

10 Claims, 1 Drawing Sheet

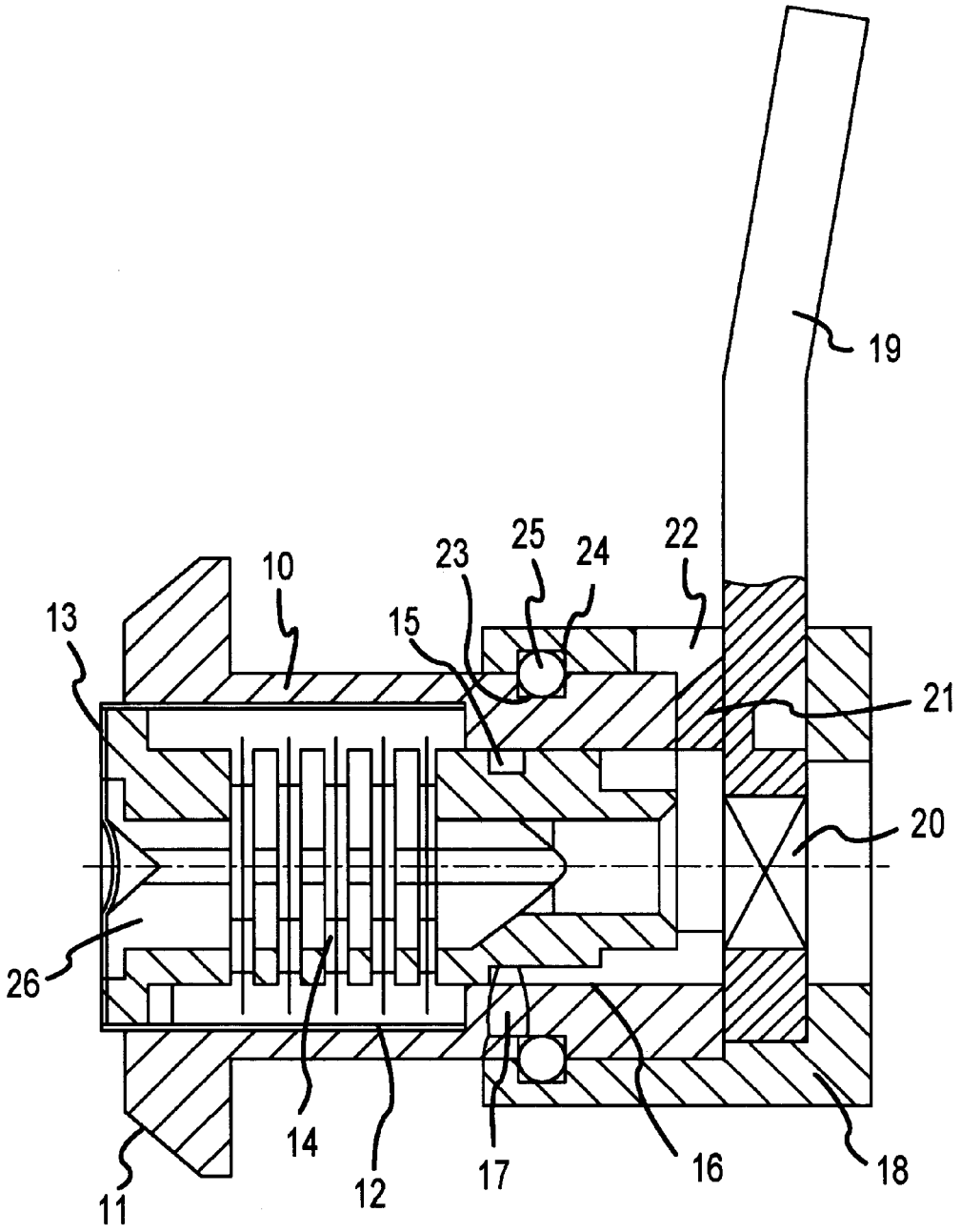
19
22
25
24
23
10
15
13
21
20
26
14
12
17
16
18
11

CASEMENT CLOSURE DEVICE

BACKGROUND OF THE INVENTION

The invention relates to a casement closure device for a door, in particular of switch cabinets or the like, with a housing that can be fixed to the door leaf or to the cabinet body, a key-operated lock cylinder arranged in the housing, and a locking tongue that can be rotated between an unlocking position and a locking position.

EP 0 504 144 B1 describes a casement closure device with the aforesaid, features. In one exemplary embodiment therein (FIG. 12), a lock cylinder for a key is arranged in the housing of the casement closure device, the housing to be fixed in a positive fit in an associated through-hole in the door. The lock cylinder is connected to a locking tongue attached to the end such that rotating the key inserted in the lock cylinder translates into rotating the locking tongue between its unlocking position and its locking position.

Such a casement closure device is associated with the disadvantage that the tightening torque that has to be applied via the lock cylinder, that is, by rotating the key, is not great enough to turn the locking tongue between its unlocking position and its locking position. If the door and the cabinet body are under opposing stress, there is a risk that the force that has to be applied to turn the locking tongue will cause the key to break off or will damage the lock cylinder. In addition, the casement closure device is not sufficiently secure against vandalism. That is, the entire casement closure device must be exchanged if the lock cylinder is intentionally destroyed or damaged such that the associated key can no longer be inserted therein.

The object of the invention is therefore to eliminate the aforesaid disadvantages in a casement closure device having the features cited in the foregoing and to make possible high tightening torque for actuating the locking tongue despite, using a lock cylinder for access.

SUMMARY OF THE INVENTION

This object is achieved, including advantageous embodiments and further developments of the invention, from the contents of the patent claims that follow this specification.

The basic idea behind the invention is that the lock cylinder is uncoupled from the locking tongue, and is locked in the housing when the key is withdrawn and can be removed from the housing when the key is inserted and moved to the unlocking position, and in that the locking tongue mounted on the housing has an actuation opening for engaging, in a positive locking manner, an actuating means that can be inserted in a housing channel, said channel being free when the lock cylinder is removed from the housing. The invention is associated with the advantage that the lock cylinder only protects the casement closure device against unauthorized opening but is not used for actuating the locking tongue. That is, once the key is inserted and the unlocking position has been achieved, the entire lock cylinder can be rotated in the housing and removed from its positive-fit connection to the housing. Then a separate actuating means that engages in the actuation opening of the locking tongue arranged at the end of the housing can be inserted into the housing channel, which is now free, so that the separate actuating means rotates the locking tongue. Subsequently the lock cylinder can be re-inserted into the housing channel of the housing and locked therein. If the lock cylinder is destroyed, intentionally or unintentionally, the lock cylinder can be drilled out of the housing, whereupon the casement closure device can still be operated and only the lock cylinder then has to be replaced.

In accordance with one exemplary embodiment of the invention, for fixing the lock cylinder in the housing it is provided that the housing has a pin that projects into the housing channel and the lock cylinder has a groove that runs around an exterior circumferential segment and that has an axially extending groove extension for engaging the pin, the extension extending to the free end of the lock cylinder.

In accordance with the invention the lock cylinder is uncoupled from the locking tongue, so in accordance with one exemplary embodiment of the invention the locking tongue is fixed in a shell or sleeve that is mounted on the housing and that can be rotated relative to the housing between the locking position and the unlocking position of the locking tongue, whereby in a preferred exemplary embodiment of the invention the sleeve can be embodied as a cap sleeve placed on the exterior of the housing at the rear.

For producing a positive fit connection that makes possible the required relative rotation of the cap sleeve bearing the locking tongue relative to the housing, in accordance with one exemplary embodiment of the invention it is provided that the housing has an exterior annular groove and in the wall of the cap sleeve is embodied two insertion channels running secant-wise for receiving a clamping spring that can be inserted into the cap sleeve and that radially engages with its spring legs the annular groove of the housing. This ensures that the connection is particularly simple to install and manage.

Also for simplifying assembly, in accordance with one exemplary embodiment of the invention the locking tongue is fixed in the cap sleeve in a positive fit and is held on the housing by the installation of the cap sleeve.

It can also be provided that the locking tongue has a member that projects to the housing and that engages in a recessed area that is embodied in the end of the housing and that fixes the angle of rotation for rotating the cap sleeve relative to the housing.

BRIEF DESCRIPTION OF THE DRAWINGS

The drawing illustrates one exemplary embodiment of the invention, which is described in the following. The sole FIGURE illustrates a side sectional-view of a casement closure device with assembled individual parts. E

DESCRIPTION OF PREFERRED EMBODIMENTS

The casement closure device comprises a housing 10 that has at its one end a flange 11 that is adjacent to a door leaf or cabinet body (not shown). Extending axially in the interior of the housing is a housing channel 12 in which is arranged a lock cylinder 13 into which a key, labeled 26, is inserted such that the tumblers 14 have In its forward region, which is located in the interior of the housing channel 12, the lock cylinder 13 has a groove 15 that runs radially around its circumference and that transitions into a groove extension 16 that extends in the axial direction to the free forward end of the lock cylinder 13. Correspondingly, the housing 10 has a pin 17 that projects into its channel 12 and that engages in the groove extension 16 and groove 15.

Placed over the end of the housing opposing the flange 11 is a shell embodied as a cap sleeve 18 in which a locking tongue 19 is fixed in a positive fit by means of a positive fit design; the locking tongue 19 has an actuation opening 20 that is disposed in an extension of the housing channel 12 for engaging an actuating means.

The cap sleeve 18 is joined to the housing 10 in a positive fit but can be rotated relative to the housing 10 in that arranged in the wall of the cap sleeve are two insertion channels 24 that run secant-wise for which the housing 10 has a corresponding exterior annular groove 23. inserted in the insertion channels 24 is a clamping spring 25 that with its spring legs engages in the annular groove 23 of the housing 10 such that the cap sleeve 18 is held on the housing 10 in a positive fit but is also rotatable relative to the housing 10.

For limiting the possible rotation path of the cap sleeve 18 relative to the housing 10 with regard to fixing the unlocking position or locking position of the locking tongue 19 that is connected to the cop sleeve 18, the locking tongue 19 has projecting in the direction of the end of the housing 10 a projection or member 21 that engages in a recessed area 22 arranged at the end of the housing 10, whereby the recessed area extends over part of the circumference of the housing 10 and the limiting edges of the recessed area 22 constitute the stops for the rotational movement of the cap sleeve 18 with locking tongue 19.

In the position illustrated in FIG. 1 with the key 26 inserted, the lock cylinder 13 can now be rotated into the position in which the axial groove extension 16 becomes aligned with the pin 17 of the housing so that in this position th lock cylinder 13 can be withdrawn from the housing channel 10. This means that the path is free for inserting an actuating means (not shown) in the housing channel 12 until the actuating means engages in the actuation opening 20 of the locking tongue 19. Thus, when the actuating means is inserted the locking tongue 19 can be rotated with any desired amount of force. Once the closing or opening movement of the locking tongue 19 has concluded, the actuating means is withdrawn from the housing channel 12 and then the lock cylinder 13 is re-inserted into the housing channel 12, whereby the pin 17 first enters into the axial groove extension 16 until the pin 17 enters into the radial slot 15 when the lock cylinder 13 is inserted. In this position the lock cylinder 13 can be rotated, whereby now the pin 17, as it engages in the groove 15, fixes the lock cylinder 13 so that the key 26 can be withdrawn.

The features of the subject matter of this document as disclosed in the foregoing specification, in the patent claims, in the abstract, and in the drawing can be essential individually or in any combination for achieving the invention in its various embodiments.

The specification incorporates by reference the disclosure of German priority document 198 16 959.0 of Apr. 17, 1998 and International priority document PCT/DE99/01060 of Apr. 3, 1999.

The present invention is, of course, in no way restricted to the specific disclosure of the specification and drawings, but also encompasses any modifications within the scope of the appended claims.

What we claim is:

1. A casement clousure device for a door, comprising:

a housing adapted to be fixed to a door leaf or cabinet body, wherein said housing is provided with a housing channel;

a key operated lock cylinder that is removably disposed in said channel of said housing; and a locking tongue that is held against said housing and is rotatable between an unlocking position and a locking position, wherein said lock cylinder is uncoupled from said locking tongue and is locked in said housing when a key is withdrawn from said lock cylinder, and when a key is inserted and moved to the unlocking position, said locking cylinder is removable, and wherein said locking tongue is provided with an actuation opening that is adapted to positively engage an actuating means that is insertable in said channel of said housing when said lock cylinder is removed from said housing, wherein a sleeve is disposed on said housing and is rotatable relative to said housing between said locking position and said unlocking position of said locking tongue, wherein said locking tongue is fixed in position in said sleeve, wherein said housing is provided on an outer surface thereof with an annular groove, wherein a wall of said sleeve is provided with two insertion channels that extend in a secant-like manner, wherein a clamping spring is disposed in said insertion channels, and wherein legs of said clamping spring radially engage said annular groove of said housing for establishing a positive connection that enables a relative rotation between said housing and said sleeve.

2. A casement closure device according to claim 1, wherein said housing is provided with a pin that projects into said channel of said housing, and wherein said lock cylinder is provided with a groove that extends over a portion of an outer peripheral surface of said lock cylinder, said groove having an axially extending groove extension for engaging said pin, wherein said groove extension extends to a free end of said lock cylinder.

3. A casement closure device according to claim 1, wherein said sleeve is embodied as a cap sleeve that is disposed on an outer surface of a rear portion of said housing.

4. A casement closure device according to claim 1, wherein said locking tongue is fixed in position in said sleeve in a positive manner.

5. A casement closure device according to claim 1, wherein said locking tongue is provided with a member that projects to said housing and engages in a recessed area that is formed in an end face of said housing and fixes an angle of rotation of said rotation of said sleeve relative to said housing.

6. A casement closure device for a door, comprising:

a housing adapted to be fixed to a door leaf or cabinet body, wherein said housing is provided with a housing channel;

a key-operated lock cylinder that is removably disposed in said channel of said housing; and a locking tongue that is held against said housing and is rotatable between an unlocking position and a locking position, wherein said lock cylinder is uncoupled from said locking tongue and is locked in said housing when a key is withdrawn from said lock cylinder, and when a key is inserted and moved to the unlocking position, said lock cylinder is removable, and wherein said locking tongue is provided with an actuation opening that is adapted to positively engage an actuating means that is insertable in said channel of said housing when said lock cylinder is removed from said housing, wherein a sleeve Is disposed on said housing and is rotatable relative to said housing between said locking position and said unlocking position of said locking tongue, and wherein said locking tongue is fixed in position in said sleeve, and wherein said locking tongue is provided with a member that projects to said housing and engages in a recessed area that is formed in an end face of said housing and fixes an angle of rotation of said rotation of said sleeve relative to said housing.

7. A casement closure device according to claim 6, wherein said housing is provided on an outer surface thereof with an annular groove, wherein a wall of said sleeve is provided with two insertion channels that extend in a secant-like manner, wherein a clamping spring is disposed in said insertion channels, and wherein legs of said clamping spring radially engage said annular groove of said housing for establishing a positive connection that enables a relative rotation between said housing and said sleeve.

8. A casement closure device according to claim 6, wherein said housing is provided with a pin that projects into said channel of said housing; and wherein said lock cylinder is provided with a groove that extends over a portion of an outer peripheral surface of said lock cylinder, said groove having an axially extending groove extension for engaging said pin, wherein said groove extension extends to a free end of said lock cylinder.

9. A casement closure device according to claim 6, wherein said sleeve is embodied as a cap sleeve that is disposed on an outer surface of a rear portion of said housing.

10. A casement closure device according to claim 6, wherein said locking tongue is fixed in position in said sleeve in a positive manner.

* * * * *